US007317434B2

(12) United States Patent
Lan et al.

(10) Patent No.: US 7,317,434 B2
(45) Date of Patent: Jan. 8, 2008

(54) CIRCUITS INCLUDING SWITCHES FOR ELECTRONIC DEVICES AND METHODS OF USING THE ELECTRONIC DEVICES

(75) Inventors: Je-Hsiung Lan, Irvine, CA (US); Gang Yu, Santa Barbara, CA (US)

(73) Assignee: DuPont Displays, Inc., Santa Barbara, CA (US)

( * ) Notice: Subject to any disclaimer, the term of this patent is extended or adjusted under 35 U.S.C. 154(b) by 605 days.

(21) Appl. No.: 11/003,172

(22) Filed: Dec. 3, 2004

(65) Prior Publication Data

US 2006/0119548 A1 Jun. 8, 2006

(51) Int. Cl.
*G09G 3/30* (2006.01)

(52) U.S. Cl. ..... 345/76; 345/82

(58) Field of Classification Search ..... 345/76–89, 345/204; 315/169.1, 169.2, 169.3, 169.4; 348/800; 430/139
See application file for complete search history.

(56) References Cited

U.S. PATENT DOCUMENTS

| | | | | |
|---|---|---|---|---|
| 6,734,636 | B2 | 5/2004 | Sanford et al. | |
| 2004/0129933 | A1 | 7/2004 | Nathan et al. | |
| 2004/0174349 | A1 | 9/2004 | Libsch et al. | |
| 2004/0256978 | A1 | 12/2004 | Yu et al. | |
| 2005/0052366 | A1* | 3/2005 | Kim | 345/76 |
| 2005/0062485 | A1* | 3/2005 | Hara | 324/661 |
| 2005/0083270 | A1* | 4/2005 | Miyazawa | 345/76 |
| 2005/0275352 | A1* | 12/2005 | Sun | 315/169.3 |
| 2006/0113918 | A1* | 6/2006 | Lo et al. | 315/169.2 |

FOREIGN PATENT DOCUMENTS

WO WO 2004/015667 A1 2/2004

OTHER PUBLICATIONS

U.S. Appl. No. 10/892,992, filed Jul. 16, 2004, Stevenson et al.
U.S. Appl. No. 10/893,211, filed Jul. 16, 2004, Chen et al.
J.-H. Kim et al., Amorphous silicon TFT-based active-matrix organic polymer LEDs, J. of Electron Device Letters, IEEE, vol. 24(7):451-453, 2003.
Joon-Chul Goh et al., A new a-Si:H thin-film transistor pixel circuit for active-matrix organic light-emitting diodes, Electron Device Letters, IEEE, vol. 24(9):583-585, 2003.

* cited by examiner

*Primary Examiner*—Nitin I. Patel
(74) *Attorney, Agent, or Firm*—John H. Lamming

(57) ABSTRACT

A circuit for an electronic device includes a select unit, a data holder unit, an electronic component, a transistor, and a switch. The control terminal of the switch is coupled to a first select line, the first terminal of the switch is connected to a first electrode of the electronic component, and the second terminal of the switch is connected to a reference voltage line. A method of using an electronic component that includes such a circuit includes writing data to a pixel and driving the electronic component. The select unit and the switch are configured to turn on at substantially a same time, and the select unit and the switch are configured to turn off at substantially a same time during writing and driving, respectively.

23 Claims, 8 Drawing Sheets

CIRCUITS INCLUDING SWITCHES FOR ELECTRONIC DEVICES AND METHODS OF USING THE ELECTRONIC DEVICES

BACKGROUND OF THE INVENTION

1. Field of the Invention

This invention relates in general to circuits and electronic devices, and more particularly, to circuits including switches for electronic devices and methods of using such electronic devices.

2. Description of the Related Art

Electronic devices, including organic electronic devices, continue to be more extensively used in everyday life. Examples of organic electronic devices include Organic Light-Emitting Diodes ("OLEDs"). Active Matrix OLED ("AMOLED") displays include pixels each having its own pixel circuit. A very large number of pixel circuits have been proposed. A basic circuit design includes a two transistor, one capacitor (2T-1C) design. The transistors may be n-channel, p-channel, or a combination thereof. One transistor is a select transistor, and the other transistor is a driving transistor. Typically, the transistors are thin-film transistors ("TFTs"). TFTs and organic active layers degrade over time.

One pixel design that has been proposed to compensate for the degradation includes adding another transistor that is connected in series with the driving transistor. In some instances where n-channel transistors are used, the extra transistor would have its drain region connected to a $V_{dd}$ power supply line and its source region connected to the drain region of the driving transistor. The source region of the driving transistor is connected to the anode of the OLED, and the cathode of the OLED is connected to a $V_{ss}$ power supply line. Even while on, the extra transistor adds resistance to the conduction path through the driving transistor and the OLED. The added resistance increases power consumption and generates more heat that needs to be dissipated without an increase in emission intensity of the OLED.

FIG. 1 includes an illustration of a pixel circuit, and FIG. 2 includes a corresponding timing diagram for the pixel circuit in FIG. 1. Referring to FIG. 1, the pixel circuit includes a select transistor 102, a capacitor 104, a driving transistor 106, and an OLED 108, which are configured similar to a 2T-1C pixel circuit. Node 105 lies between the select and driving transistors 102 and 106, respectively. The driving transistor 106 is a double-gated transistor, and a third transistor 122 has its drain connected to node 107. The voltages for $V_{dd}$, $V_{ss}$, and signal line 162 are at substantially constant voltages. For example, $V_{dd}$ can be approximately +13 V, $V_{ss}$ can be approximately −5 V, and signal line 162 can be approximately −12 V.

The timing diagram illustrates the voltages of selected parts of the circuit during one frame time. A first portion of the frame time is used to adjust voltages within the circuit, a second portion is used to write data into the pixel, and a third portion allows the pixel (i.e., OLED) to radiate.

During the first portion of the frame time, the top gate ("TG") 166 of the driving transistor 106 is brought to a low-state (e.g., negative voltage), which turns off the driving transistor 106, i.e., no significant current is flowing from its drain to its source. The select line ("SL") 142 is taken to an on-state and activates the select transistor 102 for the entire row of the display panel, and signal line ("G") 164 is taken to an on-state and activates the third transistor 122. The voltages at nodes 105 and 107 are clamped to the voltage of the data line ("DL") 144 and the signal line 162, respectively. The voltage across the capacitor 104 is thus the voltage difference between the DL 144 and the signal line 162. After a period of time, the top gate ("TG") 166 is taken to a high state (e.g., zero or positive potential), and the signal G 164 is taken to an off-state state to deactivate the third transistor 122. The voltage ("$V_c$") across the electrodes of the capacitor 104 decreases, and the voltage at node 107 increases and stabilizes at a voltage that is equal to the magnitude but opposite the polarity of the threshold voltage of the driving transistor 106. For example, the voltage of the node 107 is <2 V if the threshold voltage of the driving transistor 106 is 2 V.

During the second portion, data is written into the pixel. The signal on the DL 144 is transmitted to the node 105. The SL 142 receives an on pulse for a relatively short amount of time. TG 166 is taken to an off-state, and therefore, no significant current flows through the driving transistor 106, and the node 107 remains at its potential (e.g., less than 2 V). During the third portion, after which all data has been written for all rows (or columns, depending on the layout orientation), TG 166 is taken to a high state (zero or a positive potential) to activate the driving transistor 106 while transistor 102 is in an off-state to keep the node 105 isolated from the DL 144. The OLED 108 radiates due to a current defined by ($V_{node\ 105}$-$V_{node\ 107}$-$V_{th\text{-}OLED}$) during the writing period.

The pixel circuit 100 suffers from at least one or both of two problems, namely, low intensity and having to drive the electronics harder. A separate voltage adjust step is used. The adjust step biases portions of the pixel circuit 100 so that the OLED 108 no longer radiates until after all the data has been written to the array (end of the second portion). The time that the array radiates is less than half of the frame time. Although the various time periods are typically shorter than those of which a human can visually respond, a user may perceive the display as being dimmer, or the OLED 108 may need to be driven harder during radiation to make the display appear to have the proper emission intensity. Driving the OLED 108 harder increases the degradation rate of the driving transistor 106, the organic layer within the OLED 108, or both.

SUMMARY OF THE INVENTION

A circuit for an electronic device includes a select unit that includes a control terminal, a first terminal, and a second terminal. The control terminal is connected to a first select line, and the first terminal of the select unit is connected to a data line. The circuit also includes a data holder unit that includes a first terminal and a second terminal. The first terminal of the data holder unit is connected to the second terminal of the select unit. The circuit further includes an electronic component that includes a first electrode and a second electrode, and the electronic component is connected to a first power supply line. The circuit still further includes a transistor that includes a first gate electrode, a first source/drain region, and a second source/drain region. The first gate electrode is connected to the first terminal of the data holder unit and the second terminal of the select unit. The first source/drain region is connected to the first electrode of the electronic component and coupled to the second terminal of the data holder unit. The second source/drain region is coupled to a second power supply line. Within the circuit, the transistor is an only transistor having both of its source/drain regions lying in a conduction path between the first and second power supply lines. The circuit yet further includes a switch that includes a control terminal, a first terminal, and a second terminal. The control terminal of the switch is coupled to the first select line, the first terminal of the switch is connected to the first electrode of the electronic component, and the second terminal of the switch is connected to a reference voltage line. The select unit and the switch are configured to turn on at substantially a same time, and the select unit and the switch are configured to turn off at substantially a same time.

For a method of using an electronic device, an electronic device includes a select unit connected to a select line and a data line; a data holder unit connected to the select unit; an electronic component connected to a first power supply line, and a transistor connected to the data holder unit, the select unit, and the electronic component and coupled to a second power supply line; and a switch coupled to the select line and connected to the electronic component and to a reference voltage line. The transistor includes a first source/drain region and a second source/drain region. Within a pixel, the transistor is an only transistor having both of its source/drain regions lying in a conduction path between the first and second power supply lines. The method of using the electronic device, including the pixel, includes writing data to the pixel. Writing the data includes turning on the select unit and the switch at substantially a same time and turning off the transistor. The method also includes driving the electronic component. Driving the electronic component includes turning off the select unit and the switch at substantially a same time and turning on the transistor.

The foregoing general description and the following detailed description are exemplary and explanatory only and are not restrictive of the invention, as defined in the appended claims.

BRIEF DESCRIPTION OF THE DRAWINGS

The invention is illustrated by way of example and not limitation in the accompanying figures.

Figure 1:
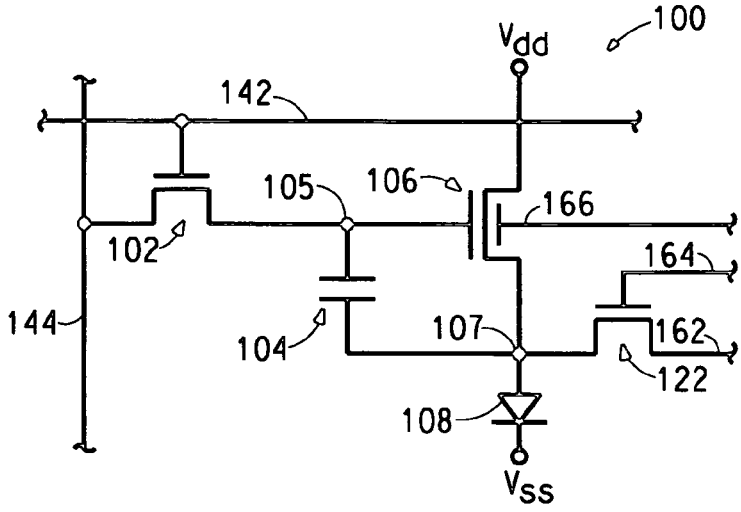
FIGS. 1 and 2 include circuit and timing diagrams for a pixel circuit.
Figure 2:
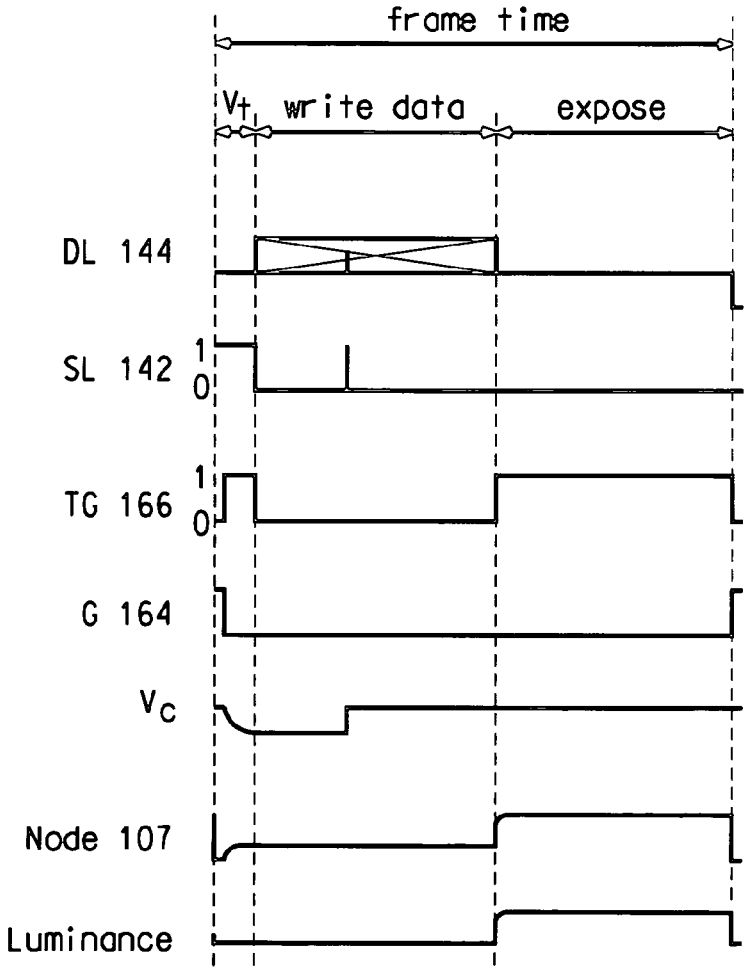

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

A circuit for an electronic device includes a select unit that includes a control terminal, a first terminal, and a second terminal. The control terminal is connected to a first select line, and the first terminal of the select unit is connected to a data line. The circuit also includes a data holder unit that includes a first terminal and a second terminal. The first terminal of the data holder unit is connected to the second terminal of the select unit. The circuit further includes an electronic component that includes a first electrode and a second electrode, and the electronic component is connected to a first power supply line. The circuit still further includes a transistor that includes a first gate electrode, a first source/drain region, and a second source/drain region. The first gate electrode is connected to the first terminal of the data holder unit and the second terminal of the select unit. The first source/drain region is connected to the first electrode of the electronic component and coupled to the second terminal of the data holder unit. The second source/drain region is coupled to a second power supply line. Within the circuit, the transistor is an only transistor having both of its source/drain regions lying in a conduction path between the first and second power supply lines. The circuit yet further includes a switch that includes a control terminal, a first terminal, and a second terminal. The control terminal of the switch is coupled to the first select line, the first terminal of the switch is connected to the first electrode of the electronic component, and the second terminal of the switch is connected to a reference voltage line. The select unit and the switch are configured to turn on at substantially a same time, and the select unit and the switch are configured to turn off at substantially a same time.

In another embodiment, the transistor includes a second gate electrode coupled to a signal line. In still another embodiment, the second terminal of the data holder unit is connected to the first electrode of the electronic component. In a more specific embodiment, the second source/drain region of the transistor is connected to the second power supply line.

In a further embodiment, a channel region of the transistor was formed using a-Si, CGS, LTPS, or a combination thereof. In still a further embodiment, each of the select unit and the switch comprises a transistor. In yet a further embodiment, the control terminal of the switch is connected to the first select line.

In another embodiment, the circuit further includes a second select line different from the first select line, wherein the reference voltage line is the second select line. In still another embodiment, the reference voltage line and the first power supply line are at substantially a same potential. In a more specific embodiment, the circuit further includes an inverter having an input terminal and an output terminal. The input terminal is connected to the first select line, and the output terminal is connected to the control terminal of the switch.

In a further embodiment, the reference voltage line is configured to be at a voltage, such that no significant current would flow through the electronic component when the switch is closed.

In another embodiment, an electronic device includes an array of pixels, wherein each of the pixels includes the circuit. In still a further embodiment, an organic electronic device includes the circuit.

For a method of using an electronic device, an electronic device includes a select unit connected to a select line and a data line; a data holder unit connected to the select unit; an electronic component connected to a first power supply line, and a transistor connected to the data holder unit, the select unit, and the electronic component and coupled to a second power supply line; and a switch coupled to the select line and connected to the electronic component and to a reference voltage line. The transistor includes a first source/drain region and a second source/drain region. Within a pixel, the transistor is an only transistor having both of its source/drain regions lying in a conduction path between the first and second power supply lines. The method of using the electronic device, including the pixel, includes writing data to the pixel. Writing the data includes turning on the select unit and the switch at substantially a same time and turning off the transistor. The method also includes driving the electronic component. Driving the electronic component includes turning off the select unit and the switch at substantially a same time and turning on the transistor.

In another embodiment, the transistor includes a first gate electrode connected to the select unit and a second gate electrode connected to a signal line. Turning off the transistor includes sending a signal along the signal line to the second gate electrode, wherein the signal has a voltage sufficient to turn off the transistor. In still another embodiment, the switch has a control terminal connected to the select line. In a more specific embodiment, the switch has a first terminal connected to a first electrode of the electronic component, and the switch has a second terminal connected to a second electrode of the electronic component or a different select line.

In a further embodiment, the switch is connected to no more than one pixel. In still a further embodiment, during writing, a substantial amount of charge across the electronic component is dissipated. In yet a further embodiment, the electronic component includes an organic active layer.

In another embodiment, the select unit and the switch are configured to turn on at substantially a same time, and the select unit and the switch are configured to turn off at substantially a same time. In still another embodiment, a frame time is a sum of a writing time for writing data and a driving time for driving the electronic component, wherein the driving time is at least half of the frame time.

In a further embodiment, the electronic component does not emit a significant amount of radiation during writing.

The detailed description first addresses Definitions and Clarification of Terms followed by Circuit Diagram, Timing Diagram, Double-Gated TFT, Other Physical Layout Considerations, Other Embodiments, and finally, Advantages.

1. Definitions and Clarification of Terms

Before addressing details of embodiments described below, some terms are defined or clarified. The term "amorphous silicon" ("a-Si") is intended to mean one or more layers of silicon having no discernible crystalline structure.

The terms "array," "peripheral circuitry," and "remote circuitry" are intended to mean different areas or components of an electronic device. For example, an array may include pixels, cells, or other structures within an orderly arrangement (usually designated by columns and rows). The pixels, cells, or other structures within the array may be controlled locally by peripheral circuitry, which may lie on the same substrate as the array but outside the array itself. Remote circuitry typically lies away from the peripheral circuitry and can send signals to or receive signals from the array (typically via the peripheral circuitry). The remote circuitry may also perform functions unrelated to the array. The remote circuitry may or may not reside on the substrate having the array.

The term "black layer" is intended to mean a layer that transmits no more than approximately 10% of radiation at a targeted wavelength or spectrum.

The term "capacitive electronic component" is intended to mean an electronic component configured to act as a capacitor when illustrated in a circuit diagram. An examples of a capacitive electronic components include a capacitor or a transistor structure.

The term "charge carriers," with respect to an electronic component or circuit, is intended to mean the smallest unit of charge. Charge carriers can include n-type charge carriers (e.g., electrons or negatively charged ions), p-type charge carriers (e.g., holes or positively charged ions), or any combination thereof.

The term "channel region" is intended to mean a region lying between source/drain regions of a field-effect transistor, whose biasing, via a gate electrode of the field-effect transistor, affects the flow of carriers, or lack thereof, between the source/drain regions.

The term "circuit" is intended to mean a collection of electronic components that collectively, when properly connected and supplied with the proper potential(s), performs a function. A TFT driving circuit for an organic electronic component is an example of a circuit.

The term "conduction path" is intended to mean a portion of a circuit in which charge carriers can flow. Source/drain regions of a transistor lie along a conduction path because, when the transistor is on, electrons, holes, or both may flow between them. Note that the gate electrode does not lie along such conduction path because charge carriers cannot pass through the gate dielectric layer of the transistor.

The term "connected," with respect to electronic components, circuits, or portions thereof, is intended to mean that two or more electronic components, circuits, or any combination of at least one electronic component and at least one circuit do not have any intervening electronic component lying between them. Parasitic resistance, parasitic capacitance, or both are not considered electronic components for the purposes of this definition. In one embodiment, electronic components are connected when they are electrically shorted to one another and lie at substantially the same voltage. Note that electronic components can be connected together using fiber optic lines to allow optical signals to be transmitted between such electronic components.

The term "continuous grain silicon" ("CGS") is intended to mean a type of polysilicon in which individual crystals are oriented in a direction parallel to the channel length of a field-effect transistor. The oriented crystals reduce the frequency with which a charge encounters a grain boundary, resulting in an overall higher mobility of the channel region compared to a randomly oriented polysilicon channel.

The term "coterminous" is intended to mean having the same or coincident boundaries.

The term "coupled" is intended to mean a connection, linking, or association of two or more electronic components, circuits, systems, or any combination of: (1) at least one electronic component, (2) at least one circuit, or (3) at least one system in such a way that a signal (e.g., current, voltage, or optical signal) may be transferred from one to another. A non-limiting example of "coupled" can include a direct connection between electronic component(s), circuit(s) or electronic component(s) or circuit(s) with switch(es) (e.g., transistor(s)) connected between them.

The term "data holder unit" is intended to mean an electronic component or a collection of electronic components configured to retain data on at least a temporary basis. An image holder unit is an example of a data holder unit, wherein the data corresponds to at least a portion of an image.

The term "data line" is intended to mean a signal line having a primary function of transmitting one or more signals that comprise information.

The term "effective gate width" is intended to mean the width of a portion of a conductor that is separated from a channel region only by gate dielectric layer(s) of the a field-effect transistor. In one embodiment, the effective gate width is the same as the physical width of a conductor, and in another embodiment, the effective gate width is part, but not all, of the physical width of a conductor.

The term "electronic component" is intended to mean a lowest level unit of a circuit that performs an electrical function. An electronic component may include a transistor, a diode, a resistor, a capacitor, an inductor, or the like. An electronic component does not include parasitic resistance (e.g., resistance of a wire) or parasitic capacitance (e.g., capacitive coupling between two conductors connected to different electronic components where a capacitor between the conductors is unintended or incidental).

The term "electronic device" is intended to mean a collection of circuits, organic electronic components, or combinations thereof that collectively, when properly connected and supplied with the proper voltage(s), performs a function. An electronic device may include or be part of a system. An examples of an electronic device includes a display, a sensor array, a computer system, an avionics system, an automobile, a cellular phone, another consumer or industrial electronic product, or the like.

The term "field-effect transistor" is intended to mean a transistor, whose current carrying characteristics are affected by a voltage on a gate electrode. A field-effect transistor includes a junction field-effect transistor (JFET) or a metal-insulator-semiconductor field-effect transistor (MISFET), including a metal-oxide-semiconductor field-effect transistor (MOSFETs), a metal-nitride-oxide-semiconductor (MNOS) field-effect transistor, or the like. A field-effect transistor can be n-channel (n-type carriers flowing within the channel region) or p-channel (p-type carriers flowing within the channel region). A field-effect transistor may be an enhancement-mode transistor (channel region having a different conductivity type compared to the transistor's source/drain regions) or depletion-mode transistor (the transistor's channel and source/drain regions have the same conductivity type).

The term "inverter" is intended to mean a circuit that receives an input signal in one of two binary states (0 or 1, low or high, false or true, etc.) and produces an output signal in the opposite state.

The term "low-temperature polysilicon" ("LTPS") is intended to mean one or more layers of polysilicon deposited or processed at a temperature no greater than 550° C. One example of a process for forming LTPS is Sequential Lateral Solidification ("SLS"), in which a modified excimer laser crystallization ("ELC") process is used to form oriented grains of larger sizes, resulting in higher mobilities for charge carriers, when compared to conventional ELC techniques for forming LTPS.

The term "$n^+$ doped" or "$p^+$ doped," with respect to a material, layer, or region is intended to mean such material, layer, or region includes a sufficient amount of an n-type or p-type dopant, such that such material, layer, or region is capable of forming an ohmic contact when a metal-containing material or layer contacts such doped material, layer, or region. In one embodiment, an $n^+$ doped region has at least $1\times10^{19}$ negatively charged carriers/$cm^3$.

The term "organic active layer" is intended to mean one or more organic layers, wherein at least one of the organic layers, by itself, or when in contact with a dissimilar material is capable of forming a rectifying junction.

The term "organic electronic device" is intended to mean a device including one or more semiconductor layers or materials. An organic electronic device includes, but is not limited to: (1) a device that converts electrical energy into radiation (e.g., a light-emitting diode, light emitting diode display, diode laser, or lighting panel), (2) a device that detects a signal using an electronic process (e.g., a photodetector, a photoconductive cell, a photoresistor, a photoswitch, a phototransistor, a phototube, an infrared ("IR") detector, or a biosensors), (3) a device that converts radiation into electrical energy (e.g., a photovoltaic device or a solar cell), (4) a device that includes one or more electronic components that include one or more organic semiconductor layers (e.g., a transistor or a diode), or any combination of devices in items (1) through (4). The term "physical channel length" is intended to mean the actual distance between the source/drain regions of a transistor.

The term "physical gate width" is intended to mean the actual width of a gate electrode for a transistor.

The term "pixel" is intended to mean a portion of an array corresponding to one electronic component and its corresponding electronic component(s), if any, that are dedicated to that specific one electronic component. In one embodiment, a pixel has an OLED and its corresponding pixel driving circuit. Note that a pixel as used in this specification can be a pixel or subpixel, as those terms are used by skilled artisans outside of this specification.

The term "pixel circuit" is intended to mean a circuit within a pixel. In one embodiment, the pixel circuit may be used in a display or a sensor array.

The term "pixel driving circuit" is intended to mean a circuit within an array of pixels or subpixels that controls the signal(s) for no more than one pixel. Note that a driving circuit that controls the signal(s) for only one subpixel, and not the entire pixel, is still referred to as a pixel driving circuit, as used in this specification.

The term "polysilicon" is intended to mean a layer of silicon made up of randomly oriented crystals.

The term "power supply line" is intended to mean a signal line having a primary function of transmitting power.

The term "radiation-emitting component" is intended to mean an electronic component, which when properly biased, emits radiation at a targeted wavelength or spectrum of wavelengths. The radiation may be within the visible-light spectrum or outside the visible-light spectrum (ultraviolet ("UV") or infrared ("IR"). A light-emitting diode is an example of a radiation-emitting component.

The term "radiation-responsive component" is intended to mean an electronic component which can sense or otherwise respond to radiation at a targeted wavelength or spectrum of wavelengths. The radiation may be within the visible-light spectrum or outside the visible-light spectrum (UV or IR). An IR sensor and a photovoltaic cell are examples of radiation-sensing components.

The term "rectifying junction" is intended to mean a junction within a semiconductor layer or a junction formed by an interface between a semiconductor layer and a dissimilar material in which charge carriers of one type flow easier in one direction through the junction compared to the opposite direction. A pn junction is an example of a rectifying junction that can be used as a diode.

The term "reference voltage line" is intended to mean a signal line having a primary function of providing a reference voltage.

The term "scan line" is intended to mean a select line whose activation occurs as a function of time.

The term "semiconductor" is intended to mean a material that is capable of including or having a rectifying junction formed therein or when such material is in contact with a dissimilar material (e.g., a metal-containing material).

The term "select line" is intended to mean a specific signal line within a set of signal lines having a primary function of transmitting one or more signals used to activate one or more electronic components, one or more circuits, or any combination thereof when the specific signal line is activated, wherein other electronic component(s), circuit(s), or any combination thereof associated with another signal line within the set of signal lines are not activated when the specific signal line is activated. The signal line within the set of signal lines may or may not be activated as a function of time.

The term "select unit" is intended to mean one or more electronic components, one or more circuits, or a combination thereof controlled by a signal on a select line.

The term "signal" is intended to mean a current, a voltage, an optical signal, or any combination thereof. The signal can be a voltage or current from a power supply or can represent, by itself or in combination with other signal(s), data or other information. Optical signals can be based on pulses, intensity, or a combination thereof. Signals may be substantially constant (e.g., power supply voltages) or may vary over time (e.g., one voltage for on and another voltage for off).

The term "signal line" is intended to mean a line over which one or more signals may be transmitted. The signal to be transmitted may be substantially constant or vary. Signal lines can include control lines, data lines, scan lines, select lines, power supply lines, or any combination thereof. Note that signal lines may serve one or more principal functions.

The term "significant amount of radiation" means a sufficiently detectible amount of radiation sufficient for one of ordinary skill in the art to determine that the radiation is being emitted. For example, if the electronic component 328 is an OLED, a significant amount of radiation represents the lowest designed intensity of radiation that is to be emitted from the electronic component 328 at the electronic component 328's targeted emission wavelength or spectrum. More specifically, if the electronic component is designed for 256 levels of intensity, 1/256 of the maximum designed intensity would mark the lower limit for a significant amount of radiation.

The term "significant current" means an amount of current sufficient for an electronic component to be operated in its intended function. For example, when the electronic component is an OLED, a significant current is an amount of current sufficient to cause the OLED to emit a detectable amount of radiation at the OLED's targeted emission wavelength or spectrum. Leakage current through an electronic component is not significant current for the purposes of this specification.

The term "source/drain region" is intended to mean a region of a field-effect transistor that injects charge carriers into a channel region or receives charge carriers from the channel region. A source/drain region can include a source region or a drain region, depending upon the flow of current through the field-effect transistor. A source/drain region may act as source region when current flows in one direction through the field-effect transistor, and as a drain region when current flows in the opposite direction through the field-effect transistor.

The term "switch" is intended to mean one or more electronic components configured to act as a switch when illustrated in a circuit diagram. Examples of switches include diode and transistor structures, mechanical (e.g., manual) switches, electromechanical switches (e.g., relays), etc. In one embodiment, a switch includes terminals through which current flows and a control that can be used to allow or adjust current flowing through the switch or to keep current from flowing through the switch.

The term "thin-film transistor" or "TFT" is intended to mean a field-effect transistor in which at least a channel region of the field-effect transistor is not principally a monocrystalline semiconductor material. In one embodiment, the channel region of a TFT includes a-Si, polycrystalline silicon, continuous-grain silicon or a combination thereof.

As used herein, the terms "comprises," "comprising," "includes," "including," "has," "having" or any other variation thereof, are intended to cover a non-exclusive inclusion. For example, a method, process, article, or apparatus that comprises a list of elements is not necessarily limited to only those elements but may include other elements not expressly listed or inherent to such method, process, article, or apparatus. Further, unless expressly stated to the contrary, "or" refers to an "inclusive or" and not to an "exclusive or." For example, a condition A or B is satisfied by any one of the following: A is true (or present) and B is false (or not present), A is false (or not present) and B is true (or present), and both A and B are true (or present).

Additionally, for clarity purposes and to give a general sense of the scope of the embodiments described herein, the use of the "a" or "an" are employed to describe one or more articles to which "a" or "an" refers. Therefore, the description should be read to include one or at least one whenever "a" or "an" is used, and the singular also includes the plural unless it is clear that the contrary is meant otherwise. The phrase "X is selected from A, B, and C" is equivalent to the phrase "X is selected from the group consisting of A, B, and C", and is intended to mean that X is A, or X is B, or X is C. The phrase "X is selected from 1 through n" is intended to mean that X is 1, or X is 2, . . . or X is n.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Group numbers corresponding to columns within the periodic table of the elements use the "New Notation" convention as seen in the CRC Handbook of Chemistry and Physics, 81st Edition (2000).

To the extent not described herein, many details regarding specific materials, processing acts, and circuits are conventional and may be found in textbooks and other sources within the organic light-emitting display, photodetector, semiconductor and microelectronic circuit arts. Details regarding radiation-emitting elements, pixels, subpixels, and pixel and subpixel circuitry will be addressed before turning to details of the radiation-sensing elements and circuitry.

2. Circuit Diagram

Figure 3:
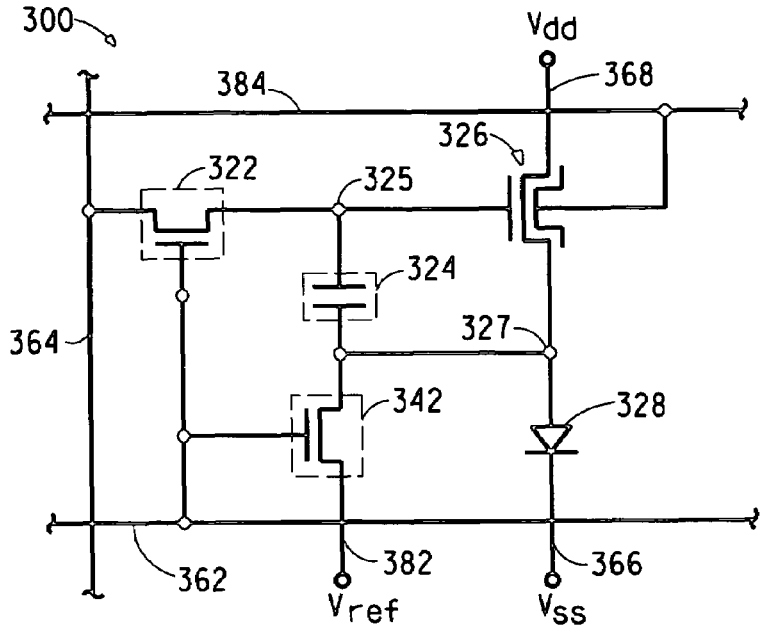
FIGS. 3 and 5 include circuit and timing diagrams for a circuit including a switch in accordance with an embodiment of the present invention.

An electronic device includes an array of pixels. Each of the pixels can include the circuit 300 as illustrated in FIG. 3. In one embodiment, the circuit 300 is a pixel circuit. In another embodiment, the electronic device includes a monochromatic display, and therefore, each pixel includes one circuit 300. In still another embodiment, the electronic device includes a full color display that includes three subpixels. Each of the subpixels includes one circuit 300. For simplicity, regardless of whether the circuit in FIG. 3 is used for a pixel or a subpixel, the term pixel circuit, as used within this specification, refers to a driving circuit for a pixel or a subpixel.

The circuit 300 includes a select unit 322. The select unit 322 includes a control terminal connected to a select line ("SL") 362, a first terminal connected to a data line ("DL") 364, and a second terminal connected to a first terminal of a data holder unit 324, a first gate electrode of a driving transistor 326, and a first terminal of a switch 342 at a node 325. SL 362 provides a control signal for the select unit 322, and DL 364 provides a data signal to be passed to the data holder unit 324 when the select unit 322 is activated. In one embodiment, the select unit 322 includes a switch. In a more specific embodiment, the switch can include a field-effect transistor, wherein its gate electrode is connected to SL 362, a first source/drain region is connected to DL 364, and a second source/drain region is connected to the data holder unit 324. In other embodiments, other transistors (including JFETs and bipolar transistors), switches, or any combination thereof may be used within the select unit 322. In still other embodiments, more or different electronic component(s) can be used within the select unit 322.

The circuit 300 also includes the data holder unit 324. The data holder unit 324 includes a first terminal and a second terminal. The first terminal of the data holder unit 324 is connected to the node 325. The second terminal of the data holder unit 324 is connected to a first source/drain region of the driving transistor 326, a first electrode of the electronic component 328, and a first terminal of a switch 342 at a node 327. The second terminal of the data holder unit 324 is also coupled to a $V_{dd}$ line 368. In one specific embodiment, the data holder unit 324 comprises a capacitive electronic component. A first electrode of the capacitive electronic component is connected to the node 325, and a second electrode of the capacitive electronic component is connected to the node 327. In an alternative embodiment (not illustrated), an optional anti-degradation unit may be connected to the data holder unit 324 and at least one of the power supply lines (e.g., $V_{ss}$ line 366, $V_{dd}$ line 368, or both).

The circuit 300 further includes the driving transistor 326. The driving transistor 326 includes a first gate electrode, a second gate electrode, a first source/drain region, and a second source/drain region. The second gate electrode of the driving transistor is connected to a signal line ("TG") 384. The first source/drain region of the driving transistor 326 is connected to the node 327, and the second source/drain region of the driving transistor 326 is connected to the $V_{dd}$ line 368. In an alternative embodiment (not illustrated), the driving transistor 326 is connected to the optional anti-degradation unit.

The circuit 300 still further includes the electronic component 328. The electronic component 328 includes a first electrode and a second electrode that is connected to the $V_{ss}$ line 366. In one embodiment, the first electrode is an anode, and the second electrode is a cathode. In another embodiment, the electronic component 328 is an organic, radiation-emitting electronic component, such as an OLED. The rest of the circuit 300 is well suited for providing a variable current source to drive the electronic component 328. Therefore, one or more electronic components that are current driven may be used in place of or in conjunction with the electronic component 328. Note that the one or more electronic components may or may not include a diode.

In one embodiment, a conduction path includes the driving transistor 326 and the electronic component 328, and the driving transistor 326 is the only transistor between the $V_{dd}$ and $V_{ss}$ lines 368 and 366. More specifically, the first and second source/drain regions of the driving transistor 326 lie along the conduction path between the $V_{dd}$ and $V_{ss}$ lines 368 and 366.

The circuit 300 yet further includes the switch 342. The switch 342 includes a control terminal coupled to SL 362, a first terminal connected to the node 327, and a second terminal connected to a voltage reference ("$V_{ref}$") line 382. SL 362 provides a control signal for the switch 342, and the $V_{ref}$ line 382 provides a voltage to the node 327. In a specific embodiment, the $V_{ref}$ line 382 is not connected to DL 362, so that data can be written into the pixel at the same time as the voltage at node 327 is being adjusted. In still another embodiment, the reference voltage line is configured to be at a voltage such that no significant current would flow through the electronic component 328 when the switch 342 is closed. In one embodiment, the switch 342 includes a field-effect transistor, wherein its gate electrode is coupled to SL 362, a first source/drain region is connected to the node 327, and a second source/drain region is connected to the $V_{ref}$ line 382. In one specific embodiment, the control terminal of the switch 342 is connected to SL 362. In other embodiments, other transistors (including JFETs and bipolar transistors), switches, or any combination thereof may be used within the switch 342. In still other embodiments, more or different electronic component(s) can be used within the switch 342.

In one embodiment, all of the select unit 322, the data holder unit 324, the electronic component 328, the driving transistor 326, and the switch 342, as illustrated in FIG. 3 may lie within the array. In another embodiment, any or all of the electronic components and units within the circuit 300, other than the electronic component 328, may lie outside the array.

The signal line 384 may be at a negative voltage, a positive voltage, or zero volts depending upon the operation of the pixel or subpixel that will be described in more detail below. The $V_{ref}$ line 382 may be at a negative voltage, a positive voltage, zero volts, or electrically float when the switch 342 is off. When the switch 342 is on, the $V_{ref}$ line 382 is at a voltage equal to or less than the voltage of the $V_{ss}$ line 366 in one embodiment. In another embodiment, the $V_{ref}$ line 382 is at a substantially constant voltage at all times when circuit 300 is operating. In still another embodiment, all unselected select lines within the array (i.e., select lines other than the select line(s) that are active (data being written)) may or may not be maintained at $V_{ref}$.

The driving transistor 326, the select unit 322, the switch 342, or any combination thereof can include a field-effect transistor. In the circuit 300 as illustrated in FIG. 3, all transistors are n-channel transistors. Any one or more of the n-channel transistors for the select unit 322, the switch 342, or a combination thereof can be replaced by any one or more p-channel transistors. In one specific embodiment, the field-effect transistors within the select unit 322 and the switch 342 are the same type (both n-channel or p-channel, both enhancement mode or depletion mode), so that the signal on SL 362 turns on or off the field-transistors within the select unit 322 and the switch 342 at the same time.

Figure 4:
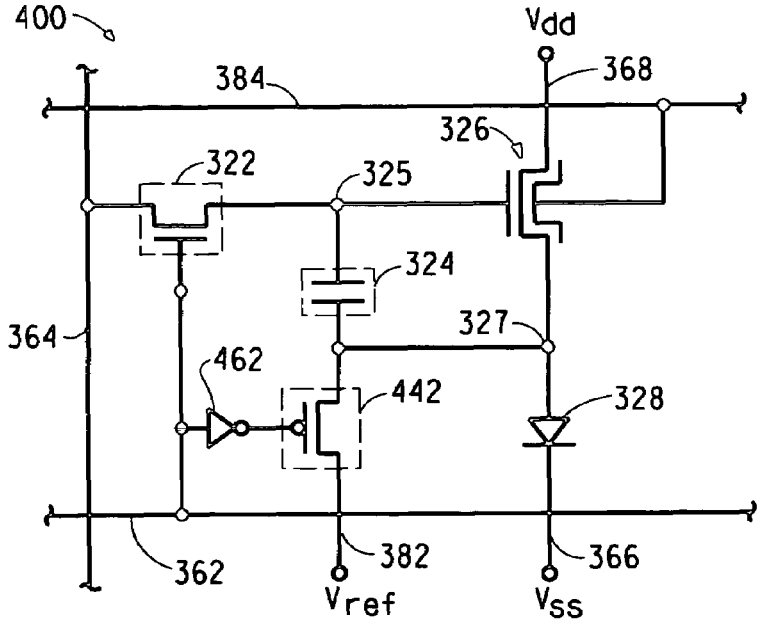
FIG. 4 includes a circuit diagram for a circuit including a switch in accordance with an alternative embodiment of the present invention.

An alternative circuit 400 is illustrated in FIG. 4. The circuit 400 is similar to circuit 300, however, a switch 442 operates in a mode substantially opposite of the switch 342. In one specific embodiment, an n-channel transistor of the switch 342 is replaced by a p-channel transistor in the switch 442. The switch 342 is coupled to SL 362, however, an inverter 462 lies between SL 362 and the switch 442. In this embodiment, an input terminal of the inverter 462 is connected to SL 362, and an output terminal of the inverter 462 is connected to the control terminal of the switch 442. The inverter 462 allows the same signal on SL 362 to turn on both the select unit 322 and the switch 442 or turn off both the select unit 322 and the switch 442. In one embodiment, the inverter 462 is conventional and may or may not be located within the array or within each pixel or subpixel.

3. Timing Diagram

Figure 5:
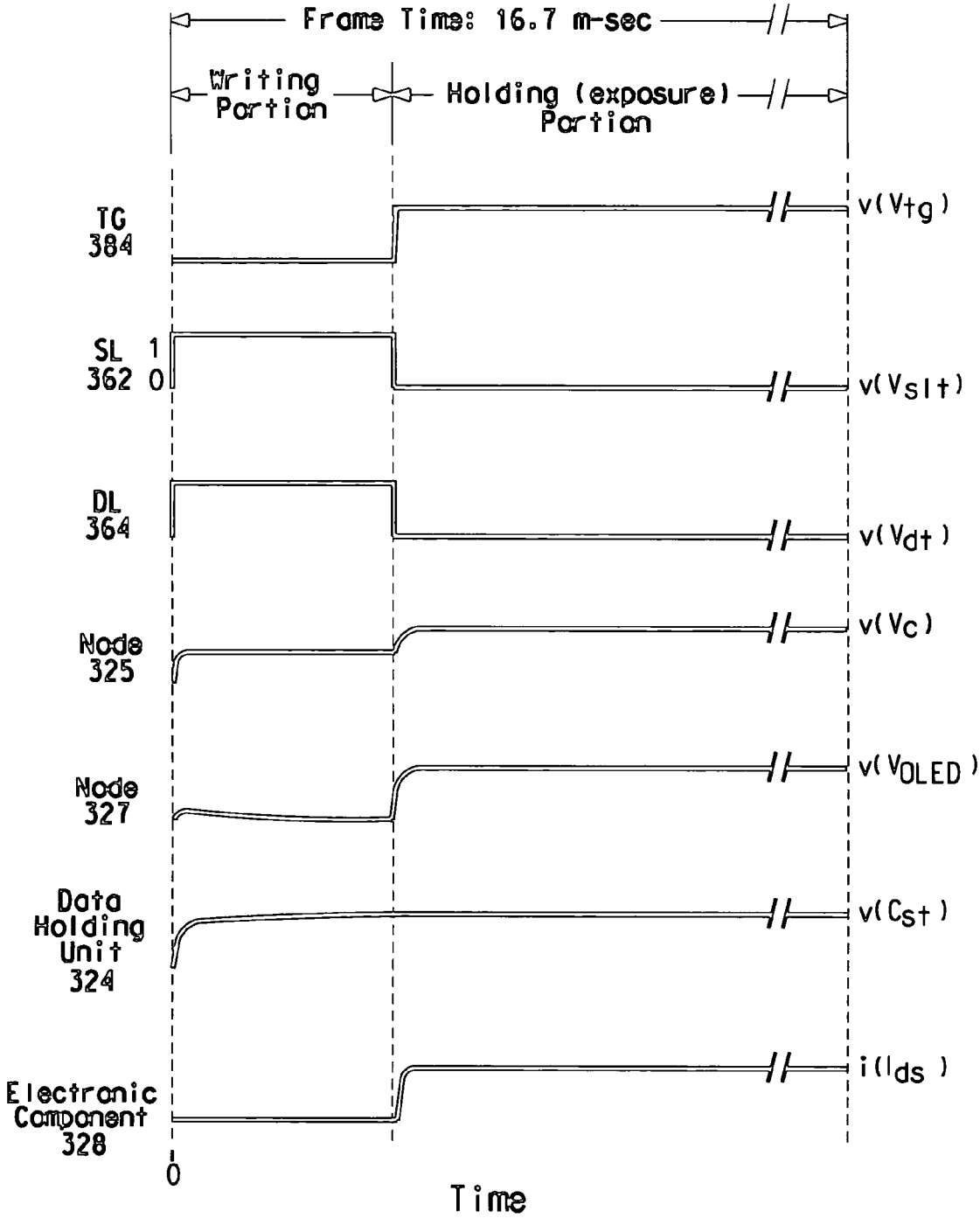

The operation of the circuit 300 is described with respect to the timing diagram in FIG. 5. The circuit 300 can be operated to include a writing portion and a radiating portion (also called holding (exposure) portion). Although not illustrated in FIG. 5, a threshold-adjust portion is not required but is optional. FIG. 5 includes a timing diagram with voltages, signals (e.g., 0 or 1), and current for portions of the circuit 300 in accordance with one non-limiting embodiment. In this embodiment, the array has 320 rows. The writing portion is 1/320 or approximately 0.3% of the frame time, which is significantly less than half of the frame time. The radiating portion is substantially the remaining portion of the frame time or greater than 99% of the frame time. During the writing portion, the electronic component 328 does not emit a significant amount of radiation. For example, if the electronic component 328 is an OLED, the electronic component 328 does not emit radiation at the electronic component 328's targeted emission wavelength or spectrum.

In one embodiment, the voltages on the $V_{ss}$ line 366, $V_{dd}$ line 368, and $V_{ref}$ line 382 are substantially constant. The actual voltages used for the $V_{ss}$ line 366, $V_{dd}$ line 368, and $V_{ref}$ line 382 are not critical, however, the differences between the voltages can be significant. In a specific embodiment, the voltage difference between the voltages on the $V_{dd}$ line 368 and $V_{ss}$ line 366 is in a range of approximately 5 to 20 volts, and the $V_{ref}$ line 382 has a voltage in a range as follows:

$$V_{ref} = V_{ss} + V_{th-ec328} \text{ to } \frac{-(Vdd - Vss)}{2} \text{ volts}$$

$V_{th-ec328}$ is the threshold voltage of the electronic component 328. In one embodiment, $V_{ref}$ can be from approximately $V_{th-ec328}$ to the maximum voltage at the node 327 during the radiating portion. In a specific embodiment, $V_{th-ec328}$ is in a range of approximately 2 to 2.5 V (below which there is no significant current flowing through electronic component 328 and no radiation emission occurs), and the node 327 may reach approximately 6 V. Therefore, $V_{ref}$ can be in a range of approximately 2.5 V above $V_{ss}$ to approximately 6 V below $V_{ss}$. In a specific embodiment during the radiating portion, $V_{ref}$ is in range of approximately $V_{ss}$+2.5 V to $-(V_{dd}-V_{ss})/2$ volts.

In one embodiment, SL 362 is one of several select lines corresponding to rows of pixels within an electronic device. In a specific embodiment, the line 382 is connected to a select line along an adjacent row of pixels, such as the select line for the previous (n−1) row or the following (n+1) row. In this embodiment, the voltage on the adjacent, unselected select line is the $V_{ref}$. For example, the scan pulse for a selected select line during a writing portion can be approximately +20 V, and the unselected select lines during the same writing portion are approximately −5 V. Therefore, in one embodiment, during a frame time (approximately 16.65 ms long), each select line is at approximately +20 V (on-state, writing portion) for approximately 52 microseconds and at approximately −5 V (off-state, radiating portion) for approximately 16.6 ms. In other embodiments, other voltages, and lengths of frame times, on-states and off-states may be used. An exemplary physical layout for achieving the circuit is described later in this specification.

During the writing portion, SL 362 is activated ("1" as illustrated in FIG. 5) and allows the signal on DL 364 to pass through the select unit 322. The voltage on the node 325 becomes substantially the same as the voltage on DL 364. SL 362 also provides the control signal for the switch 342. The voltage on node 327 becomes substantially the same as the voltage on the $V_{ref}$ line 382. The node 327 has substantially the same voltage as $V_{ref}$ by the end of the writing portion, which in one embodiment could be a negative voltage. The voltage difference across the terminals of the data holder unit 324 is the voltage difference between the nodes 325 and 327, which can be approximated by the difference between the voltages on the DL 364 and the $V_{ref}$ line 382. The signal on the TG 384 is taken to a negative voltage, which turns off the driving transistor 326. Therefore, substantially no current flows between the $V_{dd}$ line 368 and the $V_{ss}$ line 366 during the writing portion. In one embodiment, substantially no current flows through the electronic component 328 during the writing portion.

During the radiating portion, SL 362 is deactivated ("0" as illustrated in FIG. 5), and therefore, the select unit 322 and the switch 342 are turned off. In one specific embodiment, the SL 362 is at substantially $V_{ref}$ during the radiating portion. The signal on the TG 384 is taken to zero volts or a positive voltage, which turns on the driving transistor 326. Current flows from the $V_{dd}$ line 368, through the driving transistor 326 and electronic component 328, to the $V_{ss}$ line 366. The electronic component 328 can emit radiation at an intensity that is a function of the voltage on one or both of the first and second gate electrodes of the driving transistor 326. In one embodiment, the voltage on the node 327 increases when the driving transistor 326 is turned on. The voltage between the terminals of the data holding unit 324 stays substantially the same as that at the end of the writing period. The voltages at the nodes 325 and 327 increase by the value corresponding to the voltage across the electrodes of the electronic component 328. The emission intensity of the electronic component 328 is thus determined by the $V_{data}$, independent of the prior voltages between the electrodes of the electronic component 328.

The operation of the pixel using the circuit 300 can continue by alternating between writing and radiating portions for additional frame times.

The operation of the circuit 400 is substantially the same. The inverter 462 may cause a delay between the time the select unit 322 turns on and the switch 442 turns on. However, the delay is only a few nanoseconds and is insignificant when compared to the writing portion (e.g., less than 0.3% of the writing portion), which may be approximately 52 microseconds in one embodiment.

In another embodiment, a threshold voltage adjusting procedure can be performed to remove charge that may become trapped within one or both of the gate dielectric layers within the driving transistor 326. Exemplary threshold voltage procedures are described in more detail in U.S. patent application Ser. Nos. 10/892,992 entitled "Circuits Including Parallel Conduction Paths and Methods of Operating an Electronic Device Including Parallel Conduction Paths" by Matthew Stevenson et al. filed Jul. 16, 2004 and 10/893,211 entitled "Circuit For Driving an Electronic Component and Method of Operating an Electronic Device Having the Circuit" by Zhining Chen et al. filed Jul. 16, 2004, both of which are assigned to the current assignee hereof.

4. Double-Gated TFT

Figure 6:
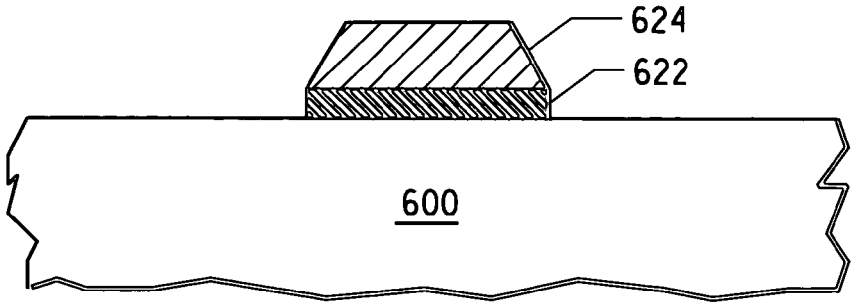
FIGS. 6 to 14 include illustrations of cross-sectional views of a double-gated TFT that may be used as a driving transistor in the pixel circuit of FIG. 3.

The driving transistor 326, as illustrated in FIG. 3, is a double-gated thin-film transistor ("TFT"). FIGS. 6 to 14 illustrate an exemplary process sequence used in forming the driving transistor 326 and a portion of the electronic component 328. FIG. 6 includes an illustration of a cross-sectional view of a portion of a substrate 600 for an electronic device. The substrate can be rigid or flexible and may contain one or more layers of an organic material, inorganic material, or both organic and inorganic materials. In one embodiment, the substrate includes a transparent material that allows at least 70% of the radiation incident on the substrate 600 to be transmitted through it.

A black layer 622 and a first gate electrode 624 are formed over the substrate 600. In one embodiment, the black layer 622 and the first gate electrode 624 can be formed using a conventional deposition and optional patterning sequence. For example, the layers for the black layer 622 and first gate electrode 624 can be deposited as patterned layers using a stencil mask. In another embodiment, the layers for the black layer 622 and first gate electrode 624 may be sequentially deposited over the substrate 600, and the black layer 622 and the first gate electrode 624 may be patterned using a conventional lithographic process. In still another embodiment, the black layer 622 may be formed over substantially all of the substrate 600, and the first gate electrode 624 may be deposited as a patterned layer over the black layer 622. The first gate electrode 624 can act as a hard mask during an etching step to remove portions of the black layer 622 that are not covered by the first gate electrode 624. In another embodiment, the black layer 622 may be omitted, and the first gate electrode 624 may be formed on the surface of the substrate 600. After reading the specification, skilled artisans will appreciate that many other techniques may be used in forming the black layer 622 and the first gate electrode 624.

The black layer 622 allows for improved contrast ratio of the electronic device when used in ambient light conditions. Materials and thicknesses of the black layer are more fully described in U.S. patent application Ser. No. 10/840,807 entitled "Array Comprising Organic Electronic Devices With a Black Lattice and Process For Forming the Same" by Gang Yu et al. filed May 7, 2004.

The first gate electrode 624 may include one or more layers that include at least one element selected from Groups 4 to 6, 8 and 10 to 14 of the Periodic Table, or any combination thereof. In one embodiment, the first gate electrode 624 can include Cu, Al, Ag, Au, Mo, or any combination thereof. In another embodiment, where the first gate electrode 624 includes more than one layer, one of the layers can include can include Cu, Al, Ag, Au, Mo, or any combination thereof and another layer can include Mo, Cr, Ti, Ru, Ta, W, Si, or any combination thereof. Note that conductive metal oxide(s), conductive metal nitride(s) or a combination thereof may be used in place of or in conjunction with any of the elemental metals or alloys thereof. In one embodiment, the first gate electrode has a thickness in a range of approximately 100 to 500 nm. In one embodiment, the thickness is approximately 300 nm.

Figure 7:
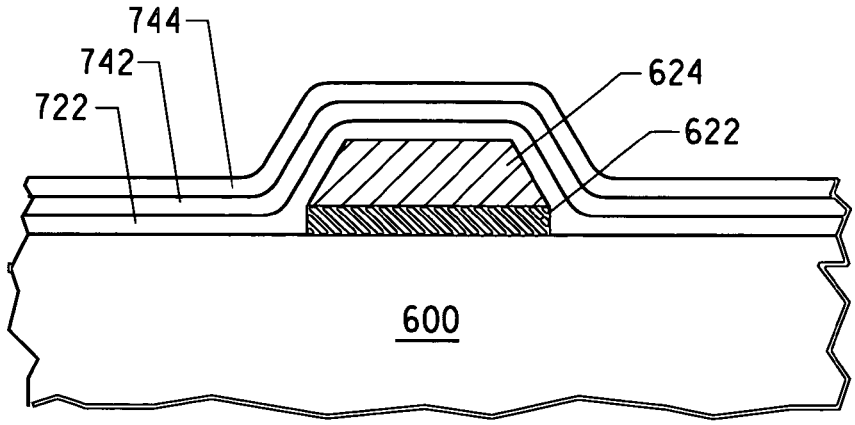

A first gate dielectric layer 722, a first semiconductor layer 742, and a second semiconductor layer 744 are sequentially formed over the substrate 600 and the first gate electrode 624 as illustrated in FIG. 7. Each of the first gate dielectric layer 722, the first semiconductor layer 742, and the second semiconductor layer 744 can be formed using conventional deposition techniques.

The first gate dielectric layer 722 can include one or more layers including silicon dioxide, alumina, hafnium oxide, silicon nitride, aluminum nitride, silicon oxynitride, another conventional gate dielectric material as used in the semiconductor arts, or any combination thereof. In another embodiment, the thickness of the first dielectric layer 722 is in a range of approximately 50 to 5000 nm.

Each of the first and second semiconductor layers 742 and 744 can include one or more materials conventionally used as semiconductors in electronic components. In one embodiment, the first semiconductor layer 742, the second semiconductor layer 744, or both are formed (e.g., deposited) as amorphous silicon (a-Si), low-temperature polysilicon (LTPS), continuous grain silicon (CGS), or any combination thereof. In another embodiment, other Group 14 elements (e.g., carbon, germanium), by themselves or in combination (with or without silicon), may be used for the first semiconductor layer 742, the second semiconductor layer 744, or both. In still other embodiments, the first and second semiconductor layers 742 and 744 include III-V (Group 13-Group 15) semiconductors (e.g., GaAs, InP, GaAlAs, etc.), II-VI (Group 2-Group 16 or Group 12-Group 16) semiconductors (e.g., CdTe, CdSe, CdZnTe, ZnSe, ZnTe, etc.), or any combination thereof.

In one embodiment, the first semiconductor layer 742 includes silicon as the only semiconductor material, and the second semiconductor layer 744 includes Ge, silicon germanium ("SiGe"), silicon carbide ("SiC") or another semiconductor material different from silicon alone or mixed with silicon. The significance of the different materials within the first and second semiconductor layers 742 and 744 will become apparent later in this specification during a patterning sequence.

The first semiconductor layer 742 is undoped or doped with, for example, a p-type dopant, at a concentration no greater than approximately $1\times10^{18}$ atoms/cm$^3$. The second semiconductor layer 744 includes an n-type or p-type dopant at a concentration greater than the first semiconductor layer 742. In one embodiment, the second semiconductor layer 744 is $n^+$ or $p^+$ doped in order to form ohmic contacts with subsequently formed metal-containing structures. In another embodiment, the dopant concentration within the second semiconductor layer 744 is less than $1\times10^{19}$ atoms/cm$^3$ and Schottky contacts would be formed when contacted with subsequently formed metal-containing structures. Conventional n-type dopants (phosphorous, arsenic, antimony, etc.) or p-type dopant (boron, gallium, aluminum, etc.) can be used. Such dopants can be incorporated during deposition or added during a separate doping sequence (e.g., implanting and annealing). The first and second semiconductor layers 742 and 744 are formed using conventional deposition and doping techniques. In one embodiment, the thickness of the first semiconductor layer 742 is in a range of approximately 100 to 250 nm, and the thickness of the second semiconductor layer 744 is in a range of approximately 10 to 100 nm. After reading this specification, skilled artisans will appreciate that other thicknesses may be used to achieve the desired electronic characteristics of the driving transistor 326.

Figure 8:
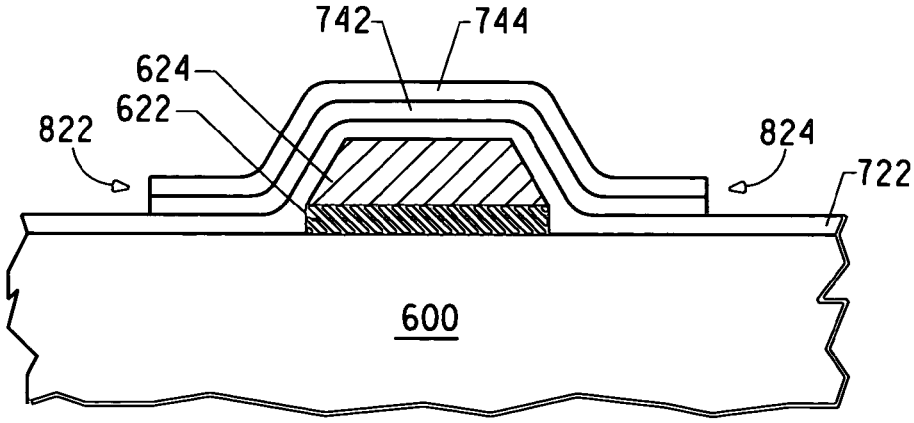
Figure 9:
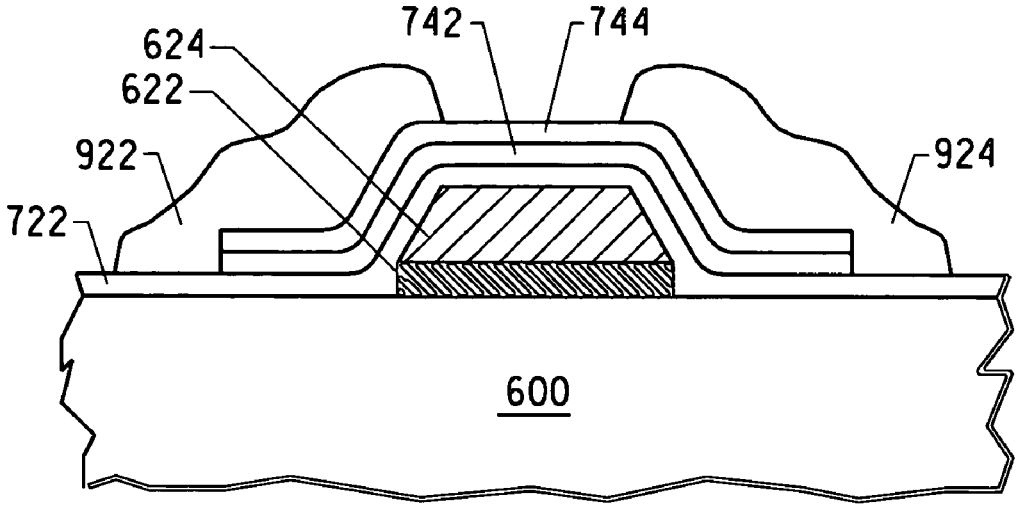

The first and second semiconductor layers 742 and 744 are patterned, as illustrated in FIG. 8, using a conventional lithographic technique. The structure formed in FIG. 8 has a pair of edges 822 and 824. Note that the first and second semiconductor layers 742 and 744 are coterminous at each of the edges 822 and 824. In another embodiment, the first and second semiconductor layers 742 and 744 are deposited as patterned layers using a stencil mask to form the patterned first and second semiconductor layers 742 and 744 as illustrated in FIG. 8.

First and second source/drain contact structures 922 and 924 are formed over portions of the first gate dielectric layer 722 and the first and second semiconductor layers 742 and 744. The first and second source/drain contact structures 922 and 924 can be formed using a conventional technique. In one embodiment, a stencil mask may be used during a deposition operation to form the first and second source/drain contact structures 922 and 924. In another embodiment, the first and second source/drain contact structures 922 and 924 are formed by depositing one or more layers over substantially all of the substrate 600 and using a conventional lithographic technique to pattern the layer(s). Any of the materials and thicknesses described with respect to the first gate electrode 624 may be used for the first and second source/drain contact structures 922 and 924.

From a plan view of the electronic device, an exposed portion of the second semiconductor layer 744 lies between the first and second source/drain contact structures 922 and 924. In one embodiment, the spacing between the first and second source/drain contact structures 922 and 924 is approximately at a minimum dimension for the design rules used. In one embodiment, when 4-micron design rules are used, the space between the first and second source/drain contacts at 922 and 924 is approximately 4 microns. In another embodiment, the space between the first and second source/drain contact structures 922 and 924 is more than the minimum dimension for the design rules. After reading this specification, skilled artisans will be able to choose a spacing between the drain and source contacts that best meet the needs or desires of a particular transistor design.

Figure 10:
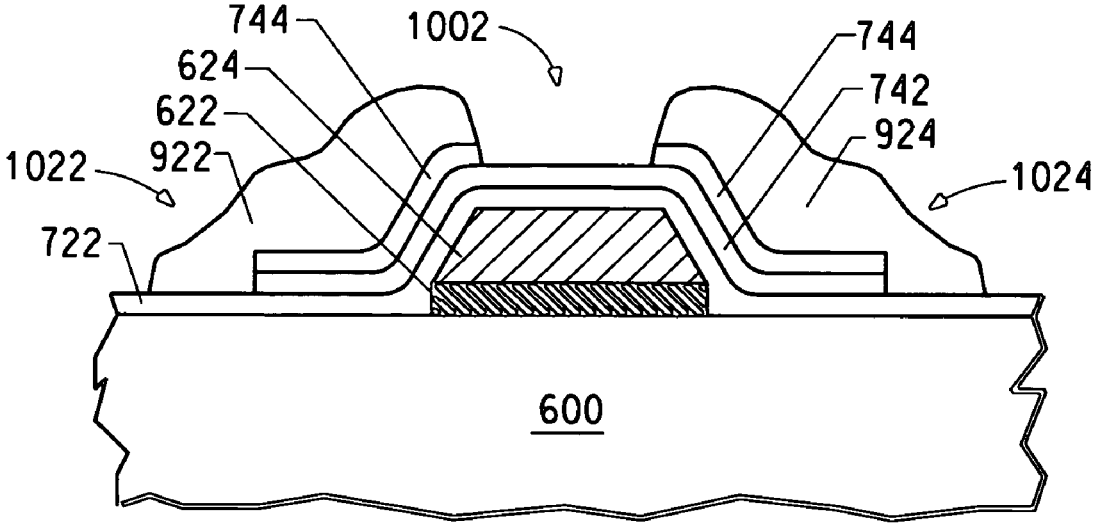

The exposed portion of the second semiconductor layer 744 is then removed to form an opening 1002 as illustrated in FIG. 10. In this embodiment, the drain and source contact structures 922 and 924 are part of a hard mask used when removing the exposed portion of the second semiconductor layer 744. Therefore, the channel region for the driving transistor 326 is self-aligned to the source/drain contact structures 922 and 924. The etch may be performed using a wet or dry etch technique. In one embodiment, the etchants used allow the second semiconductor layer 744 to be removed selectively (i.e., etch at a higher rate) with respect to the first and second source/drain contact structures 922 and 924.

In one embodiment, a halogen-containing plasma may be used by performing a dry etching technique to remove the exposed portion of the second semiconductor layer 744. The feed gas can include a halogen-containing gas, such as a fluorine-containing gas. The halogen-containing gas can be a fluorocarbon having a formula $C_aF_bH_c$, wherein a is 1 or 2, b is at least one, and b+c is 4 if a is 1 and b+c is 4 or 6 if a is 2. In another embodiment, the fluorine-containing gas can include $F_2$, HF, $SF_6$, $NF_3$, a fluorine-containing interhalogen (ClF, $ClF_3$, $ClF_5$, $BrF_3$, $BrF_5$, and $IF_5$), or any mixture thereof. In another embodiment, the halogen-containing gas is a chlorine-containing gas including $Cl_2$, HCl, $BCl_3$, a chlorine-containing interhalogen (ClF, $ClF_3$, and $ClF_5$), or any mixture thereof. In still another embodiment, the halogen-containing gas is a bromine-containing gas including $Br_2$, HBr, $BBr_3$, a bromine-containing interhalogen ($BrF_3$ and $BrF_5$), or any mixture thereof. In yet another embodiment, the halogen-containing gas is an iodine-containing gas including $I_2$, HI, or any mixture thereof. In still a further embodiment, the halogen-containing gas is any mixture of gases described in this paragraph.

The feed gas can include any one or more oxygen-containing gases, such as of $O_2$, $O_3$, $N_2O$, or other oxygen-containing gas conventionally used for creating an oxygen plasma within the semiconductor arts. The feed gas can also include one or more inert gases (e.g., a noble gas, $N_2$, $CO_2$, or any combination thereof.

The etch can be performed within an etch chamber. During the etch, the pressure is in a range of approximately 7.5 to 5000 mTorr. At these pressures, the feed gas(es) may flow at a rate in a range of approximately 10 to 1000 standard cubic centimeters per minute ("sccm"). In another embodiment, the pressure may be in a range of approximately 100 to 500 mTorr, and the feed gas(es) may flow at a rate in a range of approximately 100 to 500 sccm. The voltage and power may be applied to generate a plasma. Power is typically a linear or near linear function of the surface area of the substrate. Therefore, power densities (in power per unit area of substrate) are given. The voltage is in a range of approximately 10 to 1000 V, and the power density is in a range of approximately 10 to 5000 $mW/cm^2$. In one embodiment, the voltage may be in a range of approximately 20 to 300 V, and the power density may be in a range of approximately 50 to 500 $mW/cm^2$.

The etch may be performed as a timed etch or using endpoint detection with a timed overetch. If the first and second semiconductor layers 742 and 744 are mostly silicon, a timed etch may be used. If dissimilar materials are used for the first and second semiconductor layers 742 and 744, endpoint detection may be used. For example, in one embodiment, if the second semiconductor layer 744 includes silicon germanium, endpoint detection may be based on the absence of germanium in the effluent from the etch chamber after the first semiconductor layer 742 becomes exposed. In another embodiment, if the second semiconductor layer 744 includes germanium with nearly no silicon, endpoint detection may be based on the presence of silicon within the effluent from the etch chamber after the first semiconductor layer 742 is exposed. A timed overetch may be used to ensure that portions of the second semiconductor layer 744 are removed from areas of the substrate 600 where etching occurs more slowly. In one embodiment, the power density during the etch may be decreased during the overetch to improve selectivity of the second semiconductor layer 744 to the first semiconductor layer 742 and other portions of the electronic device exposed to the etching plasma.

Wet chemical etchants selected will be based in part on the composition of the second semiconductor layer 744 and other portions of the electronic device exposed during the etch. In one embodiment, the etchant can include a base (e.g., KOH, tetramethyl ammonium hydroxide, etc.) or a combination of an oxidizer (e.g., $HNO_3$) and HF. A timed etch is typically used for wet chemical etching.

After the etching is completed, none or some of the first semiconductor layer 742 may be removed. In one embodiment, no more than approximately 50 nm of the first semiconductor layer 742 is removed.

At this point in the process, first and second source/drain structures 1022 and 1024 are formed. The first source/drain structure 1022 includes the first source/drain contact structure 922 and the underlying portion of the second semiconductor layer 744. The second source/drain structure 1024 includes the second source/drain contact structure 924 and the underlying portion of the second semiconductor layer 744.

In one embodiment, the select unit 322 and the switch 342 include field-effect transistors. At this point in the process, transistors for the select unit 322 and the switch 342 are formed but are not illustrated in FIG. 10.

Figure 11:
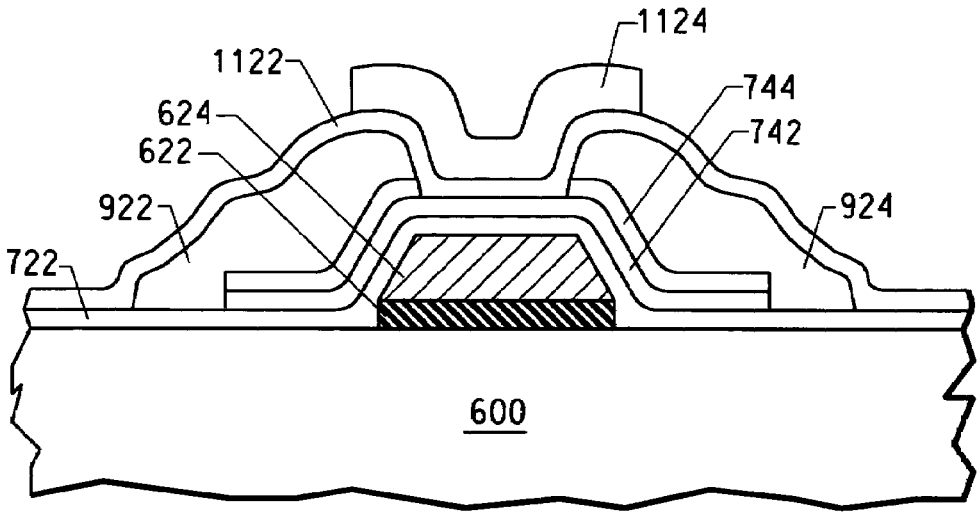

A second gate dielectric layer 1122 is formed over the first gate dielectric layer 722, the first source/drain contact structure 922, the second source/drain contact structure 924 and the first semiconductor layer 742, as illustrated in FIG. 11. The second gate dielectric layer 1122 may include any one or more layers that may contain one or more materials as previously described with respect to the first gate dielectric layer 722. In one embodiment, the second gate dielectric layer has a thickness in a range of approximately 50 to 500 nm. In another embodiment, the first and second gate dielectric layers 722 and 1122 have substantially the same composition and thickness as compared to each other. In another embodiment, the first and second gate dielectric layers 722 and 1122 have different compositions, thicknesses, or compositions and thicknesses as compared to each other.

A second gate electrode 1124 is formed over the second gate dielectric layer 1122 as illustrated in FIG. 11. In one embodiment, the second gate electrode 1124 overlies portions of the first source/drain contact structure 922, the second source/drain contact structure 924, and the first semiconductor layer 742. The second gate electrode 1124 can be formed using any one or more of the conventional techniques as described with respect to the first gate electrode 724. The first and second gate electrodes 724 and 1124 can be formed using the same or different techniques. The second gate electrode 1124 may include one or more layers and include any one or more of the materials as described with respect to the first gate electrode 624. The thickness may be in the range previously described with respect to the first gate electrode 624. In another embodiment, the first and second gate electrodes 624 and 1124 have substantially the same composition and thickness as compared to each other. In another embodiment, the first and second gate electrodes 624 and 1124 have different compositions, thicknesses, or compositions and thicknesses as compared to each other. In one embodiment, the layer(s) for second gate electrode 1124 are opaque to radiation emitted from the pixel(s), thus, forming a radiation shielding layer to cover the channel region of the driving transistor 326 and help to keep radiation from radiation emitting pixel(s) from reaching the channel regions of the driving transistor 326.

Figure 12:
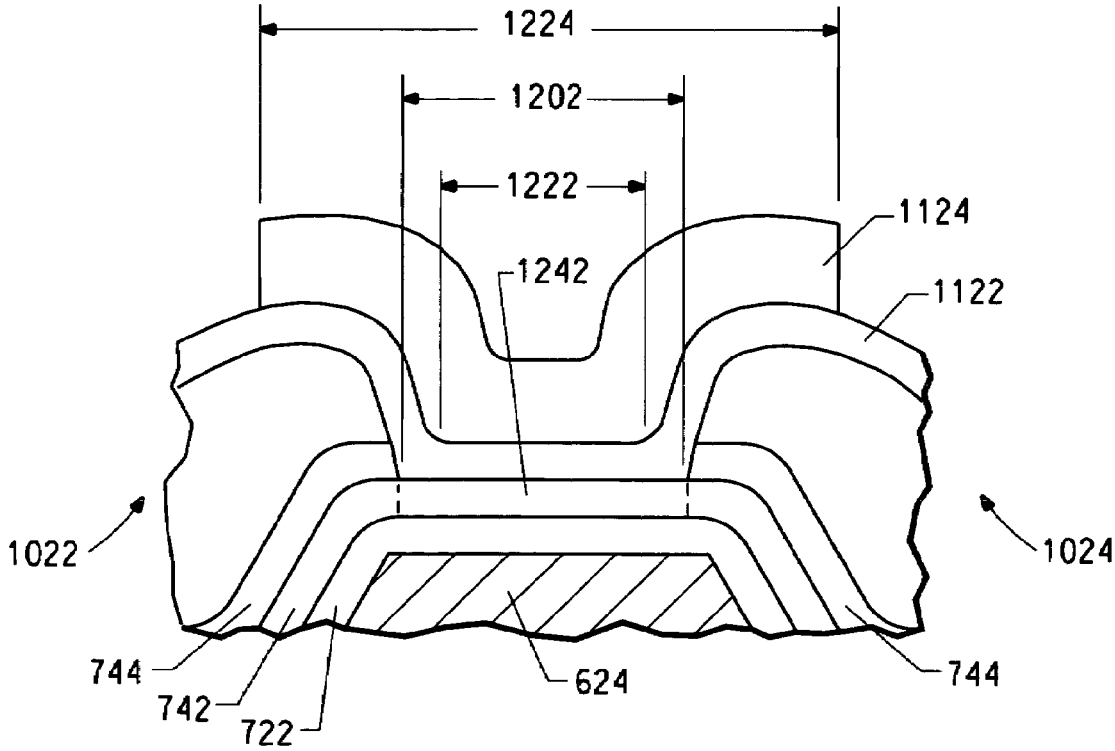

FIG. 12 includes an enlarged view of a portion of the driving transistor 326 as illustrated in FIG. 11. The channel region 1242 for the driving transistor 328 is the region of the first semiconductor layer 742 lying between the first and second source/drain structures 1022 and 1024. In this embodiment, the channel region 1242 has a physical channel length 1202 as illustrated in FIG. 12. The second gate electrode 1124 has an effective gate width 1222 and a physical gate width 1224 as illustrated by arrowed dimensions in FIG. 12.

In one embodiment, the physical channel length 1202 is no more than 2 microns greater than the effective gate width 1222. In another embodiment, the physical channel length 1202 is approximately the effective gate width 1222 plus two times the thickness of the second gate dielectric layer 1122. In still another embodiment, the difference between the physical channel length 1202 and the effective gate width 1222 is less than twice the minimum dimension of the design rules used to design the TFT. In a further embodiment, the physical channel length 1202 is no more than twice the minimum dimension of the design rules used to design the TFT. In yet a further embodiment, the physical channel length 1242 is less than the physical gate width 1224.

Figure 13:
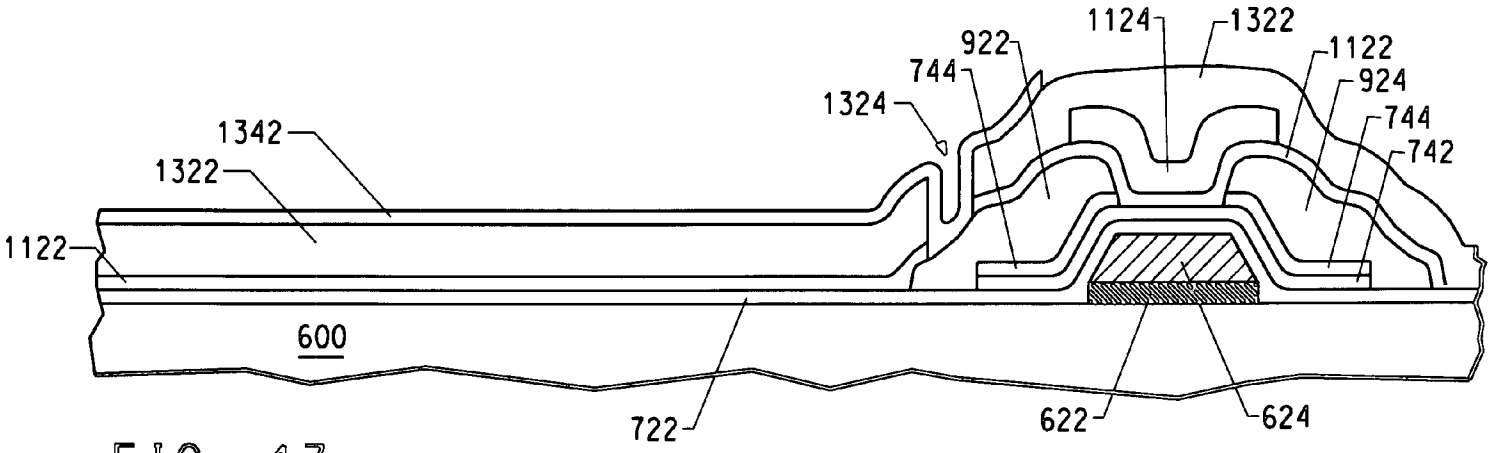

An insulating layer 1322 is formed over the substrate 600 as illustrated in FIG. 13. The insulating layer 1322 can include one or more layers of one or more of the materials described with respect to the first gate dielectric layer 722. In one embodiment the insulating layer 1322 has a thickness in a range of approximately 100 to 5000 nm. The insulating layer 1322 can be formed using a conventional deposition technique, a spin-coating technique, or a printing technique.

A contact opening 1324 is formed through the insulating layer 1322 and the second gate dielectric layer 1122 to expose a portion of the first source/drain structure 1022. A first electrode 1342 for the electronic component 328 is formed within the contact opening and extends over a portion of the substrate 600 away from the driving transistor 326 as illustrated in FIG. 13. The first electrode 1342 may include one or more layers of one or more materials conventionally used for an anode in a conventional OLED. The first electrode 1342 can be formed using a conventional deposition technique or by a conventional deposition and patterning sequence.

In one embodiment, the first electrode 1342 transmits at least 70% of the radiation to be emitted from or responded to by subsequently-formed organic active layer(s). In one embodiment, the thickness of the first electrode 1342 is in a range of approximately 100 to 200 nm. If radiation does not need to be transmitted through the first electrode 1342, the thickness may be greater, such as up to 1000 nm or even thicker.

Figure 14:
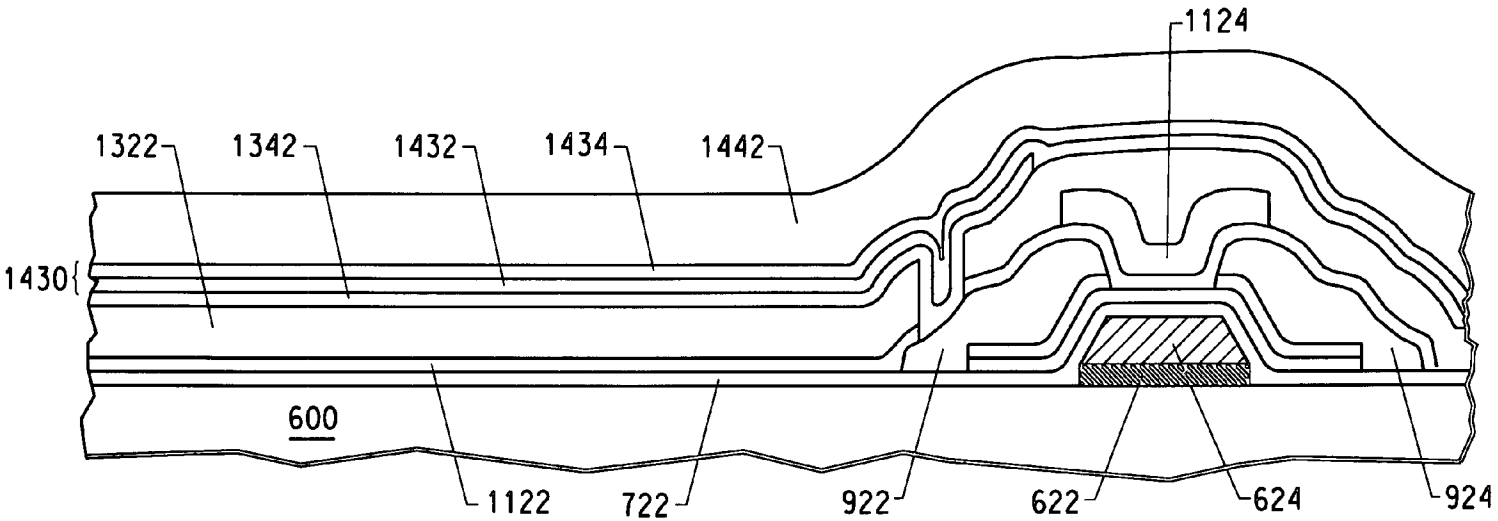

An organic layer 1430 and a second electrode 1442 are then formed over the substrate 600 as illustrated in FIG. 14. The organic layer 1430 may include one or more layers. The organic layer 1430 includes an organic active layer 1434, and optionally, may contain any one or more of a charge injection layer, a charge transport layer, a charge blocking layer, or any combination thereof. The optional charge injection layer, charge transport layer, charge blocking layer, or any combination thereof may lie a between the organic active layer 1434 and the first electrode 1342, between the organic active layer 1434 and the second electrode 1442, or a combination thereof. In one embodiment, a hole-transport layer 1432 lies between the first electrode 1342 and the organic active layer 1434. The formation of the organic layer 1430 is performed using any one or more conventional techniques used in forming organic layers in OLEDs. The hole transport layer 1432 has a thickness in a range of approximately 50 to 200 nm, and the organic active layer 1434 has a thickness in a range of approximately 50 to 100 nm. In one embodiment, only one organic active layer is used in the array. In another embodiment, different organic active layers may be used in different parts of the array.

The second electrode 1442 includes one or more layers of one or more materials used for a cathode in a conventional OLED. The second electrode 1442 is formed using one or more conventional deposition or conventional deposition and lithographic techniques. In one embodiment, the second electrode 1442 has a thickness in a range of approximately 100 to 5000 nm. In a specific embodiment, the second electrode 1442 can be a common cathode for the array.

Other circuitry not illustrated in FIG. 14 may be formed using any number of the previously described or additional layers. Although not illustrated, additional insulating layer(s) and interconnect level(s) may be formed to allow for circuitry in peripheral areas (not illustrated) that may lie outside the array. Such circuitry may include row or column decoders, strobes (e.g., row array strobe, column array strobe), or sense amplifiers. Alternatively, such circuitry may be formed before, during, or after the formation of any layers illustrated in FIG. 14. In one embodiment, the second electrode 1442 is part of the $V_{ss}$ line 366, and the second source/drain contact structure 924 is part of the $V_{dd}$ line 368. In one embodiment, the first gate electrode 624 is connected to the second terminal of the select unit 322 and the first terminal of the data holder unit 324, and the second gate electrode 1124 is part of the TG 384.

A lid (not illustrated) with a desiccant (not illustrated) is attached to the substrate 600 at locations (not illustrated) outside the array to form a substantially completed device. A gap may or may not lie between the second electrode 1442 and the desiccant. The materials used for the lid and desiccant and the attaching process are conventional.

5. Other Physical Layout Considerations

The connections for $V_{ref}$ may be implemented in a number of different ways. In one embodiment, the terminal of the switch 342 is connected to a direct current voltage through the line 382. The line 382 can be implemented as a bus line using the same layer(s) as the select line 342. In one specific embodiment, the length of the line 382 is substantially parallel to the length of the select line 362. In another embodiment, the terminal of the switch 342 is connected to the $V_{ss}$ line 366. In one specific embodiment, before forming the second electrode 1442, an opening can be formed through the organic layer 1430, the insulating layer 1322, and the second gate dielectric layer 1122 to expose a portion of the first source/drain contact structure 922 that is part of or connected to the second terminal of the switch 342 (not illustrated). The opening can be formed using a conventional lithographic process known in the semiconductor arts. The layer(s) for the second electrode 1442 are then formed and extend into the opening and contacts the second terminal of the switch 342. In this specific embodiment, the portion of the layer(s) of the second electrode 1442 lying within the opening forms the line 382 as illustrated in FIG. 3.

Figure 15:
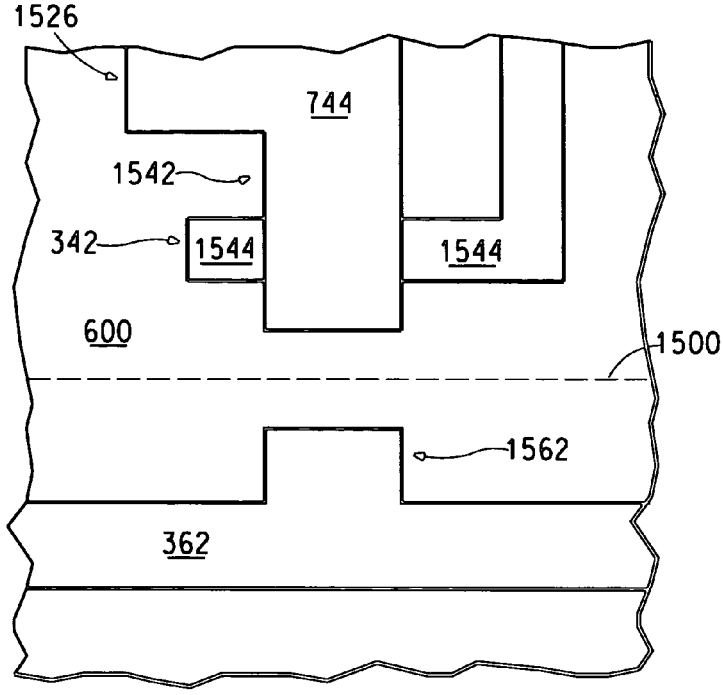
FIGS. 15 and 16 include illustrations of plan views of adjacent pixels connected to different select lines, wherein a terminal of a switch, associated with a pixel connected to one select line, is connected to a different select line.
Figure 16:
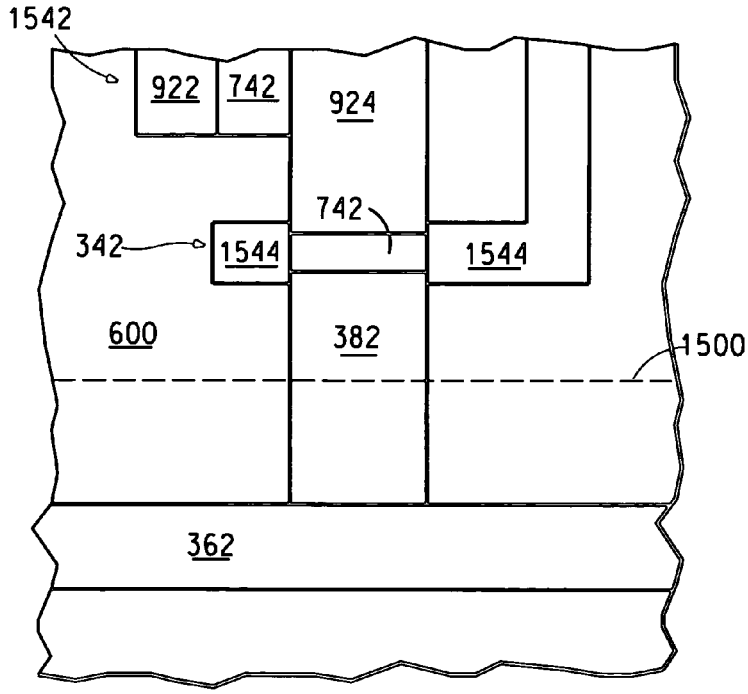

In still another embodiment, similar contacts could be made to the select lines of adjacent pixels along different rows. FIGS. 15 and 16 include illustrations of plan views within the array of an electronic device for a specific layout to achieve such a connection. FIG. 15 includes the electronic device after the first and second semiconductor layers 744 and 742 are deposited and patterned. Dashed line 1500 marks the boundary between two pixels. Below the dashed line 1500, the select line 362 is the select line for that pixel, but not for the pixel above the dashed line 1500. The select line 362 has portions 1562, one of which is illustrated in FIG. 15, to allow contacts to be made to the select line 362. Above the dashed line 1500, the conductive portion 1544 is connected to a different select line (not illustrated) for that pixel and is not connected to the select line 362 as illustrated in FIG. 15. In this specific embodiment, the conductive portion 1544 is the gate electrode for the transistor within the switch 342.

In one embodiment, the select line 362 and conductive portion 1544 are formed simultaneously with the first gate electrode 624 (not illustrated in FIG. 15). In another embodiment, any one or more of the select line 362, conductive portion 1544, and first electrode 624 may be formed at different times and may have the same or different compositions. Although not illustrated in FIG. 15, the first gate dielectric layer 722 is formed as previously described and overlies the select line 362, including portions 1562, and the conductive portion 1544. The first and second semiconductor layers 742 and 744 are formed over the first gate dielectric layer 722 as previously described. Portion 1542 of the first and second semiconductor layers 742 and 744 corresponds to the location where the transistor for the switch 342 is formed, and portion 1526 of the first and second semiconductor layers 742 and 744 corresponds to the location where the driving transistor 326 is formed.

Before the first and second source/drain contact structures 922 and 924 are formed, openings (not illustrated) would be formed to expose the portions 1562 along the select line 362. When the first and second source/drain contact structures 922 and 924 are formed, another contact structure is formed and corresponds to the line 382. The contact structure 1644 contacts one of the portions 1562 of the select line 362 and a portion of the second semiconductor layer 744 that is the second terminal of the switch 342. The portions of the second semiconductor layer 744 lying between the source/drain contact structures 922, 924, and line 382 are etched to expose underlying portions of the first semiconductor layer 742 as previously described. In this manner, line 382 is connected to select line for an adjacent row of pixels.

Unselected select lines 362 are placed at $V_{ref}$, and the selected select line 362 has a voltage sufficient to turn on the select transistors 322 and switches 342 for the selected select line 362. When the selected select line 362 become unselected, its voltage is changed to $V_{ref}$. When one of the unselected select lines 362 become selected, its voltage is changed to a value sufficient to turn on the select transistors 322 and switches 342 for the newly selected select line 362.

After reading this specification, skilled artisans will appreciate that many other physical layouts are possible. To list every conceivable physical layout and implementation would be nearly impossible. Therefore, many different physical layouts and implementations do not depart from the scope of the present invention.

6. Other Embodiments

The embodiments described above are well suited for AMOLED displays including monochromatic and full color displays. Still, the concepts described herein can be used for other types of radiation-emitting electronic components. Other radiation-emitting electronic components can include passive matrix displays, light panels, and inorganic LEDs, including III-V or II-VI-based inorganic radiation-emitting components. In one embodiment, the radiation-emitting electronic component may emit radiation within the visible light spectrum, and in another embodiment, the radiation-emitting electronic component may emit radiation outside the visible light spectrum (e.g., UV or IR).

In another embodiment, the concepts described herein may be extended to other types of electronic devices. In one embodiment, a sensor array may include an array of radiation-responsive electronic components. In one embodiment, different radiation-responsive electronic components may have the same or different active materials. The response of these active materials may change over time. Further, some of the sensor array may have different portions that receive different wavelengths, different radiation intensities, or a combination thereof. Similar to an electronic device with radiation-emitting electronic components, the lifetime of an electronic device with radiation-responsive electronic components may have a longer useful life.

Different subpixels within an array may have different voltages for the power supply lines or reference voltage lines. For example, in a full color display, all blue light-emitting components may have $V_{dd\text{-}blue}$, $V_{ss\text{-}blue}$, and $V_{ref\text{-}blue}$, all green light-emitting components may have $V_{dd\text{-}green}$, $V_{ss\text{-}green}$, and $V_{ref\text{-}green}$, and all red light-emitting components may have $V_{dd\text{-}red}$, $V_{ss\text{-}red}$, and $V_{ref\text{-}red}$. Each of the $V_{dd\text{-}blue}$, $V_{dd\text{-}green}$, and $V_{dd\text{-}red}$ may be the same or different compared to one another. Each of the $V_{ss\text{-}blue}$, $V_{ss\text{-}green}$, and $V_{ss\text{-}red}$ may be the same or different compared to one another. Each of the $V_{ref\text{-}blue}$, $V_{ref\text{-}green}$, and $V_{ref\text{-}red}$ may be the same or different compared to one another. After reading this specification, skilled artisans will be able to determine actual voltages to be used in a specific application.

Radiation to or from the electronic components may be transmitted through the substrate ("bottom emission") or through the lid ("top emission"). The positions of the first and second electrodes can be reverse, so that the cathode(s) are closer to the substrate as compared to the anode(s).

Substrate structures (not illustrated), such as a well structure or cathode separators may be formed after the first electrode 1342 and before the organic layer 1430. The substrate structures may or may not receive a surface treatment, such as fluorination or adding a surfactant to the surface of the substrate structures. Such substrate structures may or may not include a black layer to reduce the intensity of or substantially prevent radiation from the electronic component 328 from reaching the transistors within the circuit 300.

7. Advantages

The circuit 300 allows the pixel or subpixel to be on for a significantly larger portion of the frame time as compared to the circuit 100. For each pixel or subpixel, its electronic component 328 is only off during the time that the SL 364 activates the select unit 322 and the switch 342, which is a relatively small fraction of the time. Unlike circuit 100, the current through the electronic component 328 can be lower and still achieve the same emission intensity as seen by a human user of a display with circuit 300. The lower current reduces power requirements and heat generation, and therefore, decreases the degradation rate of the organic active layer within the organic layer 1430, reduces the rate that trapped charge accumulates within the first gate dielectric layer 722, and improves the reliability and lifetime of the electronic device.

The channel region 1242 can be significantly shorter compared to other double-gated TFT designs, where the source, drain, and top gate electrode structures are formed simultaneously. In other designs, the channel region has a physical channel length that is at least three times the minimum dimension of the design rules. For 4-micron design rules, the physical channel length is approximately 12 microns. The width of the top gate electrode for a conventional double-gated TFT using the 4-micron design rules is approximately 4 microns and would be centered over the channel region. Therefore, in a conventional double-gated TFT, most (approximately ⅔) of the channel region is not covered by the top gate electrode. The extra channel length increases resistance through the driving transistor and increases the size of the driving transistor and reduces the aperture ratio for bottom emission displays. Therefore, the driving transistor 328 using an embodiment described herein can be smaller, increase aperture ratio, and reduce power consumption while keeping the emission intensity the same or higher than using a conventional transistor design.

Note that not all of the activities described above in the general description or the examples are required, that a portion of a specific activity may not be required, and that further activities may be performed in addition to those described. Still further, the order in which each of the activities are listed are not necessarily the order in which they are performed. After reading this specification, skilled artisans will be capable of determining what activities can be used for their specific needs or desires.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense and all such modifications are intended to be included within the scope of the invention.

Any one or more benefits, one or more other advantages, one or more solutions to one or more, problems, or any combination thereof has been described above with regard to one or more specific embodiments. However, the benefit(s), advantage(s), solution(s) to problem(s), or any element(s) that may cause any benefit, advantage, or solution to occur or become more pronounced is not to be construed as a critical, required, or essential feature or element of any or all the claims. Various features of the invention that are, for brevity, described in the context of a single embodiment, may also be provided separately or in any subcombination. Further, reference to values stated in ranges include each and every value within that range.

What is claimed is:

1. A circuit for an electronic device, wherein the circuit comprises:

a select unit comprising a control terminal, a first terminal, and a second terminal, wherein:

the control terminal is connected to a first select line; and the first terminal of the select unit is connected to a data line;

a data holder unit comprising a first terminal and a second terminal, wherein the first terminal of the data holder unit is connected to the second terminal of the select unit;

an electronic component comprising a first electrode and a second electrode, wherein the electronic component is connected to a first power supply line;

a transistor comprising a first gate electrode, a first source/drain region, and a second source/drain region, wherein:

the first gate electrode is connected to the first terminal of the data holder unit and the second terminal of the select unit; and the first source/drain region is connected to the first electrode of the electronic component and coupled to the second terminal of the data holder unit;

the second source/drain region is coupled to a second power supply line; and within the circuit, the transistor is an only transistor having both of its source/drain regions lying in a conduction path between the first and second power supply lines; and a switch comprising a control terminal, a first terminal, and a second terminal, wherein:

the control terminal of the switch is coupled to the first select line; and the first terminal of the switch is connected to the first electrode of the electronic component; and the second terminal of the switch is connected to a reference voltage line, wherein the select unit and the switch are configured to turn on at substantially a same time, and the select unit and the switch are configured to turn off at substantially a same time.

2. The circuit of claim 1, wherein the transistor comprises a second gate electrode coupled to a signal line.

3. The circuit of claim 1, wherein the second terminal of the data holder unit is connected to the first electrode of the electronic component.

4. The circuit of claim 3, wherein the second source/drain region of the transistor is connected to the second power supply line.

5. The circuit of claim 1, wherein a channel region of the transistor was formed using a-Si, CGS, LTPS, or a combination thereof.

6. The circuit of claim 1, wherein each of the select unit and the switch comprises a transistor.

7. The circuit of claim 1, wherein the control terminal of the switch is connected to the first select line.

8. The circuit of claim 1, further comprising a second select line different from the first select line, wherein the reference voltage line is the second select line.

9. The circuit of claim 1, wherein the reference voltage line and the first power supply line are at substantially a same potential.

10. The circuit of claim 9, further comprising an inverter having an input terminal and an output terminal, wherein:

the input terminal is connected to the first select line; and the output terminal is connected to the control terminal of the switch.

11. The circuit of claim 1, wherein the reference voltage line is configured to be at a voltage, such that no significant current would flow through the electronic component when the switch is closed.

12. An electronic device comprising an array of pixels, wherein each of the pixels includes the circuit of claim 1.

13. An organic electronic device comprising the circuit of claim 1.

14. A method of using an electronic device, wherein the electronic device comprises:

a select unit connected to a select line and a data line;

a data holder unit connected to the select unit;

an electronic component connected to a first power supply line;

a transistor comprising a first source/drain region and a second source/drain region, wherein:

the transistor is connected to the data holder unit, the select unit, and the electronic component;

the transistor is coupled to a second power supply line; and within a pixel, the transistor is an only transistor having both of its source/drain regions lying in a conduction path between the first and second power supply lines; and a switch coupled to the select line and connected to the electronic component and to a reference voltage line, wherein the method comprises:

writing data to the pixel, wherein writing comprises:

turning on the select unit and the switch at substantially a same time; and turning off the transistor; and driving the electronic component, wherein driving comprises:

turning off the select unit and the switch at substantially a same time; and turning on the transistor.

15. The method of claim 14, wherein:

the transistor comprises a first gate electrode connected to the select unit and a second gate electrode connected to a signal line; and turning off the transistor comprises sending a signal along the signal line to the second gate electrode, wherein the signal has a voltage sufficient to turn off the transistor.

16. The method of claim 14, wherein the switch has a control terminal connected to the select line.

17. The method of claim 16, wherein:

the switch has a first terminal connected to a first electrode of the electronic component; and the switch has a second terminal connected to a second electrode of the electronic component or a different select line.

18. The method of claim 14, wherein the switch is connected to no more than one pixel.

19. The method of claim 14, wherein during writing, a substantial amount of charge across the electronic component is dissipated.

20. The method of claim 14, wherein the electronic component comprises an organic active layer.

21. The method of claim 14, wherein the select unit and the switch are configured to turn on at substantially a same time, and the select unit and the switch are configured to turn off at substantially a same time.

22. The method of claim 14, wherein a frame time is a sum of a writing time for writing data and a driving time for driving the electronic component, wherein the driving time is at least half of the frame time.

23. The method of claim 14, wherein the electronic component does not emit a significant amount of radiation during writing.

* * * * *